US010593309B2

(12) United States Patent
Cole

(10) Patent No.: US 10,593,309 B2
(45) Date of Patent: Mar. 17, 2020

(54) DAMPER BAR ADJUSTMENT MECHANISM FOR KEYBOARD PERCUSSION INSTRUMENT

(71) Applicant: Stephen J. Cole, Arcata, CA (US)

(72) Inventor: Stephen J. Cole, Arcata, CA (US)

(73) Assignee: MARIMBA ONE INC., Arcata, CA (US)

( * ) Notice: Subject to any disclaimer, the term of this patent is extended or adjusted under 35 U.S.C. 154(b) by 335 days.

(21) Appl. No.: 15/409,018

(22) Filed: Jan. 18, 2017

(65) Prior Publication Data

US 2018/0204552 A1 Jul. 19, 2018

(51) Int. Cl.
*G10D 13/02* (2006.01)
*G10D 13/08* (2006.01)

(52) U.S. Cl.
CPC ..... *G10D 13/085* (2013.01)

(58) Field of Classification Search
USPC ..... 84/404
See application file for complete search history.

(56) References Cited

U.S. PATENT DOCUMENTS 5,977,465 A * 11/1999 Piper ..... G10D 13/08 84/402

8,049,089 B2 11/2011 Stevens

* cited by examiner

*Primary Examiner* — Christopher Uhlir
(74) *Attorney, Agent, or Firm* — D. Pressman

(57) ABSTRACT

A keyboard percussion instrument (100) generates sounds when keys (130) or other such members are struck. A movable damper bar (140) is brought into contact with the keys to artistically shorten their ringing duration. When pressed, a pedal (145) removes the damper bar from contact with the keys. When the pedal is released, a spring (1010) urges the damper bar into contact with the keys. The damper bar is supported by a pair of arms (165) that pivot about pivot points (800) at the ends of movable posts (520) that extend from a pair of pivot height adjusting mechanisms (175). Each pivot height adjusting mechanism has two adjusting screws. A first screw (510) urges a post to move up or down and a second screw (565) fixes the post in position when tightened. Adjusting the heights of the pivot points provides control over the damping of key vibrations.

20 Claims, 3 Drawing Sheets

DAMPER BAR ADJUSTMENT MECHANISM FOR KEYBOARD PERCUSSION INSTRUMENT

BACKGROUND

Prior Art

A keyboard percussion instrument such as a marimba or vibraphone comprises a plurality of sound keys that are held in a frame. A user wields at least one mallet, striking various keys to produce musical sounds. When struck, each key produces a fundamental frequency that depends on the length of the key. The keys are supported in the frame in such a way that, when they are struck with an impulsive force, the ringing sound made by striking a key can last for a period of seconds. A user typically wishes to control, i.e., shorten, the duration of the ringing sound. The ringing sound is shortened with the use of a damper bar. A damper bar comprises an assembly including a rigidly supported felt strip or other material that is urged against one or more keys by a foot-pedal-controlled mechanism. To make a musical sound, a user presses a foot-pedal downward, removing the damper bar from contact with the keys. The user then strikes the top surface of a key with a mallet, causing the key to vibrate or ring. When the user wishes to stop the ringing sound, the foot pedal is released, urging the damper bar back into contact with the underside of a key to dampen the ringing sound.

In general, it is desirable for a damper bar to contact all the keys of an instrument simultaneously. This permits a user to dampen the ringing of all keys at the same time. Some users may want other scenarios, such as damping the treble keys first followed by the bass keys, or vice-versa. In the past, adjustment of the damping mechanism to obtain these three damping styles, i.e., all keys simultaneously, treble first, and bass first, required tools or even bending of parts of the mechanism that supported the damper bar. The need for using tools or bending parts of the damping mechanism prevented rapid adjustment of the damping mechanism, as is sometimes desirable between pieces of music during a musical performance. For example, a first musician may prefer uniform damping of all keys when the damping mechanism pedal is released, and a second musician, who is playing in the same musical set, may prefer damping bass keys first. In the past, it was impractical to accommodate the styles of both musicians during a musical performance. Even during normal maintenance of an instrument, the use of tools and bending of mechanical parts to adjust damping were at best inconvenient.

Stevens, in U.S. Pat. No. 8,049,089 B2 (2011) shows a keyboard percussion instrument having a damper bar. Stevens's damper bar is urged against the underside of his keys in response to the motion of a foot pedal and lever mechanism. Stevens provides the above three damping scenarios, i.e., damping all keys simultaneously, or progressively damping keys from one end of an instrument to the other. However he requires the use of tools to accomplish this.

Stevens provides two methods for adjusting and selecting damper bar performance through two damper bar mounting designs. In a first design, a damper bar (322 in FIGS. 4 and 5) is joined to a damper support arm (334b) by a pair (one at each end of the damper bar) of elastic elements (338). Fastening elements (339) are slidably inserted through the elastic elements and secure the damper bar to the damper support so that when a fastening element is tightened, the elastic element is compressed and the damper bar rests closer to the support arm. By selectively tightening the fastening elements at each end, any of the three damping scenarios can be achieved.

In a second design, two fastening elements (339a, 339b in FIG. 5A) additionally permit rotational adjustment of the damping bar about the long axis of the damping bar.

While Stevens provides adjustment of the damping bar to accomplish various damping scenarios, his system does not lend itself to easy and fast adjustment. I.e., it is necessary to somehow access fasteners (339) from within the end of his damping bar (322). This adjustment may need to be repeated after long use of the instrument. Thus it is difficult and awkward if sequential users of an instrument had different damping preferences. In either case, it is necessary to use tools and reach into the structure of the instrument to make the required adjustments between users.

SUMMARY

I have devised a method and apparatus that allows rapid adjustment of the height of a damping bar with respect to the underside of the keys in a keyboard percussion instrument. The height of the damping bar is independently adjustable at both ends, thus allowing selection of all three damping scenarios, i.e., all keys at once, the treble keys first, or the bass keys first. My mechanism independently supports each end of the damping bar and the height at each end is independently adjustable with thumbscrews, i.e., no tools are required. My apparatus is easily reached and quickly operated without reaching into the structure of the instrument with tools. The same adjustment of the damper bar location can be achieved by using one height adjustment mechanism at either the bass end of the instrument or the treble end instead of allowing the adjustment at both ends.

DRAWING FIGURES

Figure 6A:
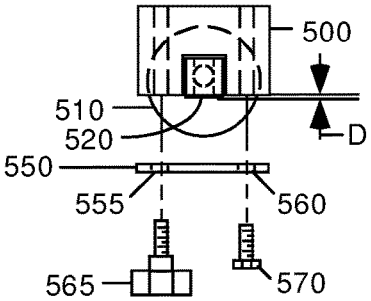
Figure 6B:
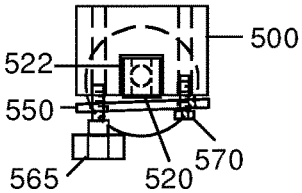
Figure 6C:
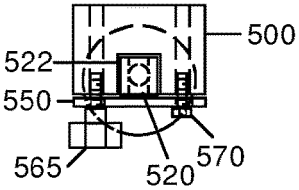

FIGS. 6A, 6B, and 6C are top views showing assembly and operation of a pivot height adjusting mechanism according to one aspect.

Figure 7:
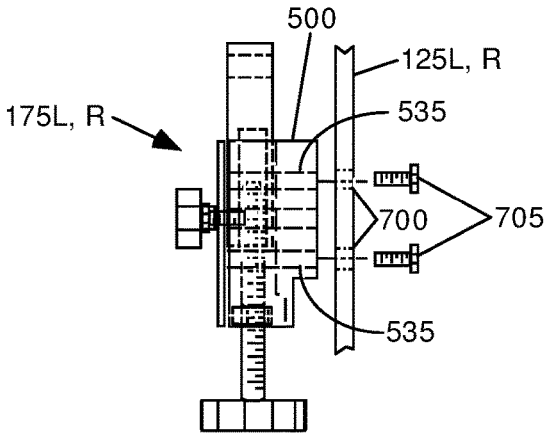

FIG. 7 is a side view showing attachment of a pivot height adjusting mechanism to a frame member of a keyboard percussion instrument.

Figure 8:
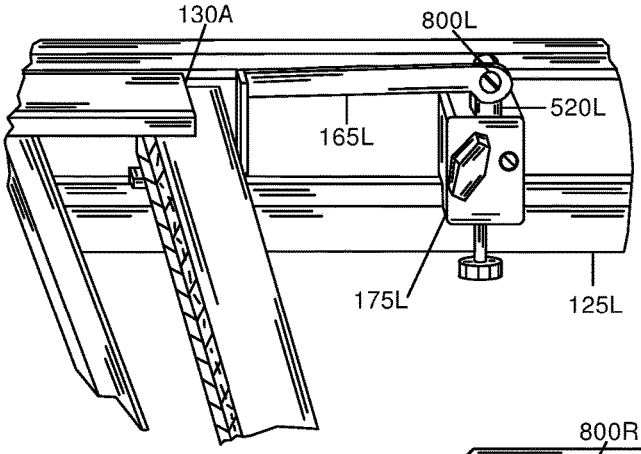
Figure 9:
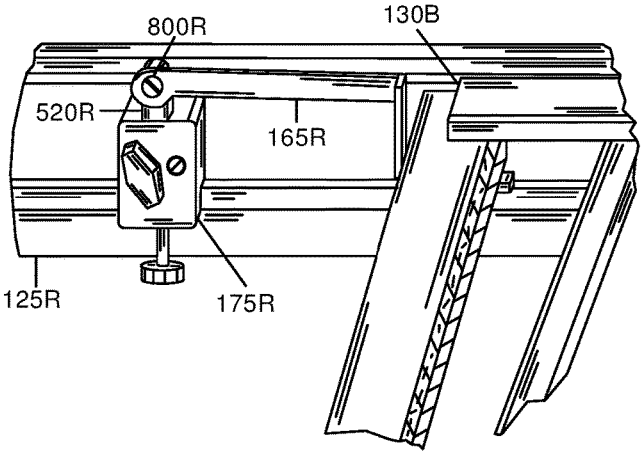

FIGS. 8 and 9 are perspective views showing left and right-hand pivot adjusting mechanisms, pivot arms, and a damper bar mounted in a keyboard percussion instrument and ready for use.

Figure 10:
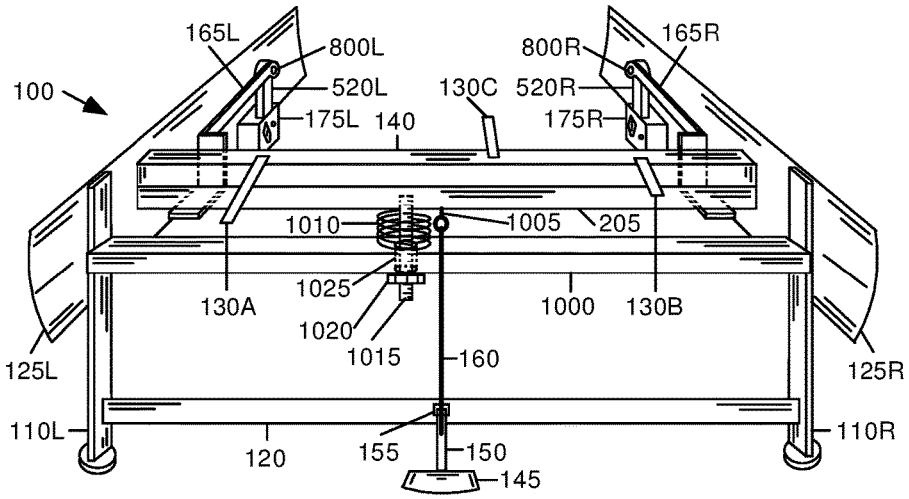

FIG. 10 is a perspective skeletal view a damping bar and associated mechanisms in place in a keyboard percussion instrument.

REFERENCE NUMERALS

| | | | |
|---|---|---|---|
| 100 | Marimba or vibraphone instrument | 105 | Leg |
| 110 | Leg | 115 | Cross member |
| 120 | Cross member | 125 | Frame member |
| 130 | Key | 135 | Support |

-continued

| | | | |
|---|---|---|---|
| 140 | Damper bar | 145 | Foot pedal |
| 150 | Arm | 155 | Hinge |
| 160 | Connecting member | 165 | Pivot arm |
| 170 | Hole | 175 | Pivot height adjusting mechanism |
| 200 | Top layer | 205 | Bottom layer |
| 300 | Hole | 400 | Fastener |
| 500 | Body portion | 505 | Adjusting screw |
| 510 | Thumbwheel | 515 | Nut |
| 520 | Post | 522 | Channel |
| 524 | Inner surface | 525 | Opening |
| 530 | Hole | 535 | Hole |
| 545 | Hole | 550 | Cover plate |
| 555 | Hole | 560 | Hole |
| 565 | Tightening thumbscrew | 570 | Hinge point screw |
| 700 | Hole | 705 | Fastener |
| 800 | Fastener | 1000 | Support beam |
| 1005 | Attachment fixture | 1010 | Spring |
| 1015 | Screw | 1020 | Nut |
| 1025 | Hole | | |

Figure 1:
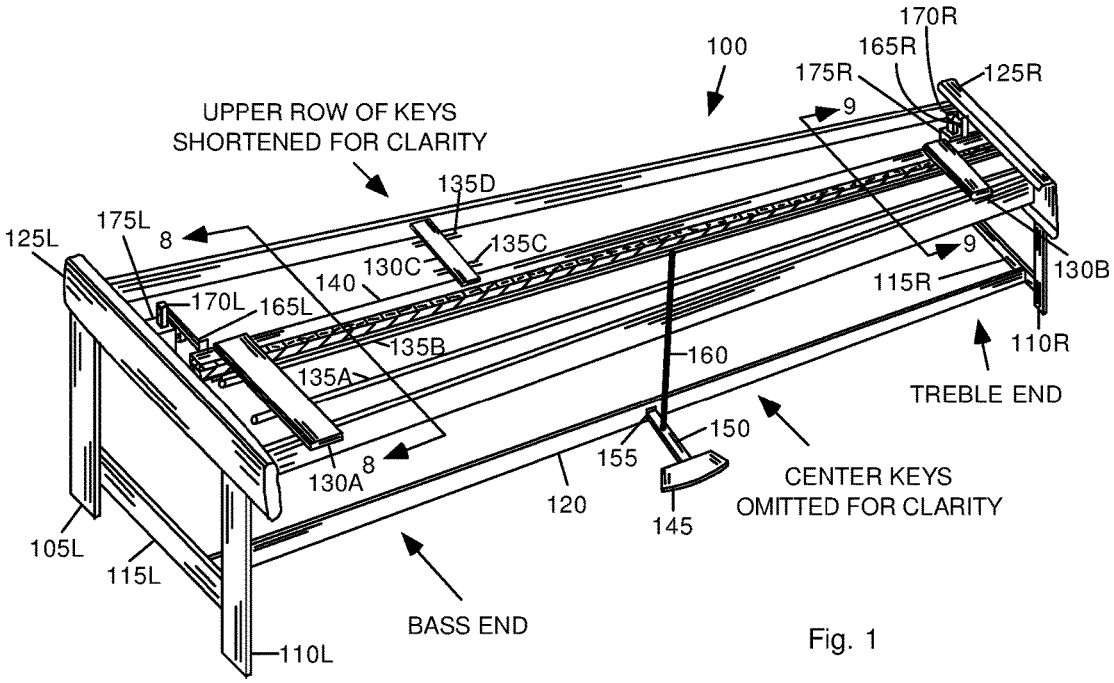
FIG. 1 is a perspective schematic view showing selected portions of a keyboard percussion instrument according to one aspect of an embodiment.

FIRST EMBODIMENT—MARIMBA With ADJUSTABLE DAMPER PIVOTS—FIG. 1—OVERVIEW

FIG. 1 is a perspective schematic view showing selected portions of a keyboard percussion instrument, such as a marimba. An instrument 100 comprises a stand having four legs 105L, 110L, and 110R, and a fourth leg that is not visible. The pair of legs at each end of the instrument are rigidly secured together by cross members 115L and 115R, respectively. A third cross member 120 is rigidly secured to cross members 115L and 115R as shown. A pair of frame members 125L and 125R are secured to the tops of the legs of each end pair, respectively. A known mechanism (not shown) is provided to raise or lower frame members 125L and 125R with respect to legs 105L, 105R, 110R, and 110L. This allows players of various heights to comfortably play the instrument. Various stationary components and other cross members are secured to frame members 125L and 125R in order to form a working instrument.

A plurality of keys 130A, 130B, and 130C rest on a plurality of supports 135A, 135B, 135C, and 135D. Only these three keys and portions of four supports are shown in this view. In practice, there are two full rows of keys and two sets of supports. The keys are arranged with lower notes near a bass end (bass keys) and higher notes near a treble end (treble keys) of instrument 100. When the top side of any key is struck with a mallet or other object, the key vibrates and produces audible sounds.

A movable damper bar 140 is positioned so that the top surface of bar 140 is springably urged by a spring 1010 (FIG. 10) into contact with or against the underside of all keys 130A, 130B, etc. in both rows. This is the normal position of damper bar 140. In this position, damper bar 140 prevents any key with which it is contact from ringing.

A foot pedal 145 is pivotally secured to cross member 120 by an arm 150 and a hinge 155. A connecting member 160, such as a rod, chain, rope, or strap, is secured to arm 150 at a first end and damping bar 140 at a second end. Pedal 145, arm 150, hinge 155, and connecting member 160 are normally positioned at the center of damper bar 140.

A pair of pivot arms 165L and 165R have their first ends secured to the respective opposite ends of damper bar 140. The second ends of arms 165L and 165R terminate in pivot holes 170L and R, by which the seconds of the arms are joined to pivot height adjusting mechanisms 175L and R, respectively. Pivot arms 165L and 165R are made of metal, plastic, reinforced plastic, or wood. These components are described in more detail below.

Figure 2:
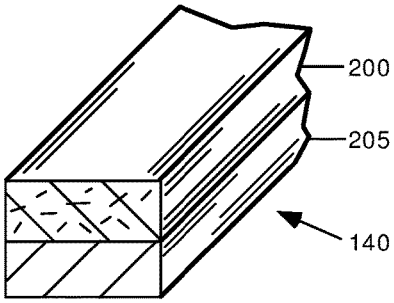
FIG. 2 is a perspective end view of a damper bar according to one aspect.
Figure 3:
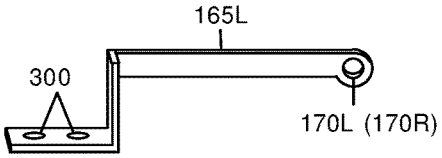
FIG. 3 is a perspective side view of a pivot arm according to one aspect.
Figure 4:
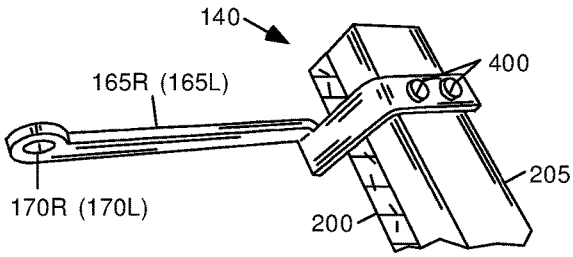
FIG. 4 is a perspective view showing attachment of a pivot arm to a damper bar.

Damper Bar and Pivot Arms—FIGS. 2 Through 4.

FIG. 2 is a perspective end view of damper bar 140. Bar 140 typically comprises two layered sections. A top layer 200 is made of felt, a fluid-filled bladder, or other material. Layer 200 preferably is slightly compressible so as not to generate unwanted sounds when contacting the underside of keys 130A, 130B, etc.

A bottom layer 205 of bar 140 is made of a rigid material such as metal, hardwood, or reinforced plastic. Layers 200 and 205 are securely attached to one another by adhesive or other fastening means.

FIG. 3 is a perspective view of pivot arm 165L. Pivot arm 165R is a mirror image version of arm 165L. Arms 165L and 165R include pivot holes 170L and 170R, respectively, at one end, and an angled section with one or more holes 300 at the opposite ends that are used to accommodate fasteners that secure arm 165L and 165R to the respective ends of damper bar 140.

FIG. 4 is a perspective view of the underside of the right-hand end of damper bar 140 showing attachment of pivot arm 165R to damper bar 140 using fasteners 400, such as screws, bolts, rivets, etc. Instead of fasteners, pivot arms 165R and 165L can be secured to bar 140 by adhesives or other means. Pivot arms 165L and 165R are secured near the opposite ends of damper bar 140.

Figure 5:
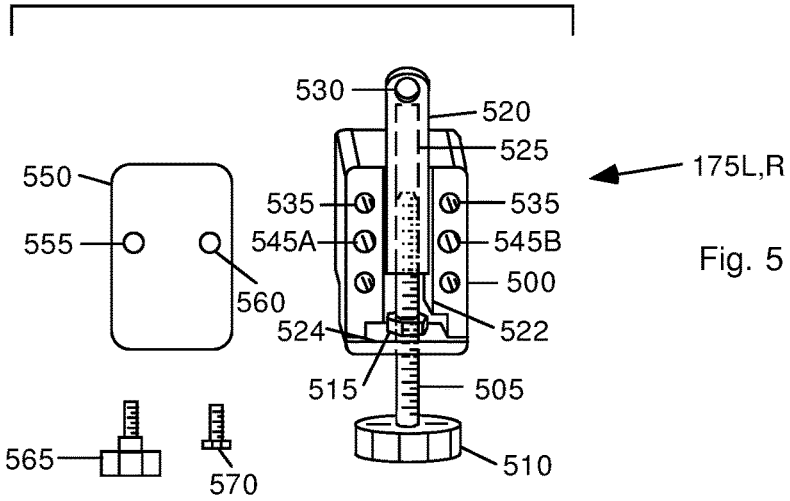
FIG. 5 is a perspective front view showing components of a pivot height adjusting mechanism.

Pivot Height Adjusting Mechanisms—Construction—FIGS. 5 Through 6C.

FIG. 5 is a perspective view of the various components comprising pivot height adjusting mechanisms 175L and 175R. These two mechanisms are identical in this disclosure, although they can optionally be mirror images of one another. Their different designations (-L and -R) refer to their placement in instrument 100.

FIG. 6A is an exploded top view of a pivot height adjusting mechanism 175. Mechanism 175 comprises a body portion 500, an adjusting thumbscrew 505 with a thumbwheel 510 fixedly secured to screw 505, a nut 515 secured to screw 505, and a post 520. Post 520 slidably moves within a channel 522 in body 500. Post 520 further includes an axial opening 525 with internal threads that rotatably engage threads on screw 505, and a pivot hole 530. Nut 515 is secured and fixed in position on screw 505. It acts as a thrust bearing against the lower, inner surface 524 of body 500 and rotates with screw 505. Post 520 extends and retracts from body 500 as screw 505 is turned. Post 520 is generally rectangular in cross-section, although it can have another cross-sectional shape, such as circular, hexagonal, or the like. A plurality of holes 535 are provided for mounting mechanism 175 to frame members 125L and 125R. Two holes 545A and 545B are used in the operation of mechanism 175, as explained below.

A cover plate 550 contains at least two holes 555 and 560 to permit the passage of a tightening thumbscrew 565 and a hinge-point screw 570 through holes 555 and 560 and into holes 545A and 545B (FIG. 5). Post 520 is sized to extend a small distance "D" (FIG. 6A) beyond a front face of body 500. Distance D is on the order of 0.5 mm, although other distances can be used. Hinge-point screw 570 provides an anchor for cover plate 550 and helps urge cover plate 550 against post 520 when thumbscrew 565 is tightened. Body portion 500 and cover plate 550 can be made of wood, metal, or plastic.

FIGS. 6B and 6C are top views showing the installation and adjustment of cover plate 550, thumbscrew 565, and hinge pin screw 570 in body 500 of mechanism 175. In FIG. 6B, thumbscrew 565 and hinge pin screw 570 are installed loosely into body 500 so that cover plate 550 does not contact the exposed side of post 520. Hinge pin screw 570 is then screwed into body 500 until cover plate 550 lightly contacts the exposed side of post 520. At this point, post 520 is free to slidably move up and down in channel 522 of body 500.

FIG. 6C is a top view showing the position of various parts when thumbscrew 565 is fully tightened. Hinge pin screw 570 provides a fulcrum about which cover plate 550 rotates. Tightening thumbscrew 565 urges cover plate 550 to rotate until plate 550 is urged tightly against the exposed surface of post 520. Thus post 520 is pressed and locked in position between cover plate 550 and the innermost surface of channel 522.

Body 500 and post 520 of mechanism 175 are made of metal, reinforced plastic, or hardwood. Nut 515, screw 505 and cover plate 550 are made of metal, although other materials can be used. Screws 565 and 570 are made of metal, although other materials can be used. Thumbscrews 510 and 565 have knurled finger grips to permit fingertip adjustment.

Pivot Height Adjusting Mechanisms—Operation—FIGS. 5 Through 6C.

Pivot height adjusting mechanism 175 is operated by first loosening thumbscrew 565 as shown in FIG. 6B, permitting post 520, and therefore pivot point 530, to move up and down within channel 522 of body 500. Thumbwheel 510 is turned until the desired height of pivot point 530 relative to the top of body 500 is reached, and then thumbscrew 565 is tightened until post 520 is immovably pressed by friction between plate 550 and the innermost surface of channel 522. Thumbscrew 565 can be left is one position such that a slight amount of pressure is exerted on post 520. This slight pressure will be enough to hold post 520 in position but will still allow thumbscrew 505 to be rotated, thus raising or lowering post 520. This can be used to advantage when a rapid raising or lowering of the pivot point 530 is required during the playing of one or several pieces of music.

Pivot Height Adjusting Mechanisms—Installation—FIGS. 7 Through 9.

FIG. 7 is a side view showing the attachment of mechanisms 175L and 175R to frame members 125L and R. A plurality of holes 700 are bored through frame members 125L and 125R. Holes 700 are positioned to match holes 535 in body 500 of mechanism 175L and 175R. A plurality of fasteners 705 are inserted through holes 700 and tightly secured in body 500, thereby securing mechanisms 175L and 175R to frame members 125L and 125R.

FIGS. 8 and 9 are perspective views showing frame members 125L and 125R with mechanisms 175L and 175R secured thereto. Arms 165L and 165R are secured to damper bar 140 at a first end as described above. A pair of fasteners 800L and 800R rotatably secure arms 165L and 165R via holes 170L and 170R to posts 520L and 520R, respectively, at their opposite ends. Fasteners 800L and 800R are screws or other fasteners that are secured in holes 530 of posts 520 (FIG. 5), but are loose enough to permit arms 165L and 165R to rotate freely thereon.

Pivot Height Adjusting Mechanisms—Operation—FIG. 10.

FIG. 10 is a perspective skeletal view of the instrument shown in FIG. 1, showing details of operation and positioning of the components of one aspect of a damping mechanism. A support beam 1000, an attachment fixture or eye bolt 1005, a spring 1010, a height-limiting screw 1015, and a nut 1020 are shown in this view. The support bar may be a separate member or the support bar may consist of one or more structures which support the keys of the instrument. Attachment fixture 1005 is secured to the underside of damper bar 140. Connecting member 160 is secured to fixture 1005 and arm 150, as described. Pedal 145 normally rests about 4 cm above the lower ends of posts 110L and 110R. When pedal 145 is at rest, i.e., not urged downward, spring 1010 urges damper bar up so that its top surface contacts keys 130A, B, C, etc. The spring is sized for this purpose. Height-limiting screw 1015 passes slidably through a hole 1025 in beam 1000. At its upper end, screw 1015 is secured into the bottom part 205 of damper bar 140. Nut 1020 is screwed downward on screw 1015 until the top surface of damper bar 140 is gently urged against the lower surface of keys 130A, B, C, etc.

Normally damper bar 140 is urged upward by spring 1010 so as to prevent any key from ringing when it is struck by a user with a mallet. When pedal 145 is pressed downward by the user's foot, connecting member 160 pulls damper bar 140 downward, away from contact with keys 130A, B, C, etc. in order to permit any key that a user strikes to ring. Fixture 1005, spring 1010, and screw 1015 are normally located at the center of damper bar 140.

In the prior art, the pivot points on damper bar arms were not readily adjustable. It was necessary to adjust these in order to ensure proper operation of the damping mechanism. I.e., damping of all keys simultaneously, or damping of the bass or treble keys first as may be required by a particular user. In some cases, the arms that supported the damper bar were manually bent to accommodate these preferences. The present apparatus permits adjustment of the damping mechanism through manual turning of thumbscrews. Thus this adjustment can be done quickly, without bending internal parts of an instrument, and without the use of tools.

The pivot points can be set at equal heights with respect to the damping bar, or they can be set at unequal heights. When the pivot point at the treble end of an instrument is higher than that at the bass end of the instrument, high notes at the treble end are damped before those at the bass end when the damping pedal is released.

Steps in adjusting pivot points. The following steps are used to adjust the height of pivot fasteners 800L and 800R, and therefore the pivot points of arms 165L and 165R. This adjustment is made when it is desired to take control over the damping of sounds produced by a keyboard percussion instrument. The adjustment is used to fine-tune operation of the damping mechanism, as described above, i.e., when it is desired to cause all keys to be damped simultaneously, or to be damped at one end of a keyboard before the other end.

1. Pedal 145 is released, allowing spring 1010 to force the damper bar up against the keys.
2. Mechanisms 175L and 175R are adjusted so that the pivot points defined by the locations of fasteners 800L and 800R are at the same heights relative to bodies 500 (FIG. 6) of mechanisms 175L and 175R.
3. Nut 1020 (FIG. 10) on screw 1015 is adjusted so that the upper surface of damper bar 140 just contacts one of keys 130A or 130B.
4. If damper bar 140 contacts keys 130A and 130B with the same force, determined by the relative upward displacement of keys 130A and 130B, the pivot point adjustment process is complete.
5. If damper bar 140 contacts key 130A, but not key 130B, then the pivot point defined by fastener 800R is raised by adjusting mechanism 175R until damper bar 140 contacts keys 130A and B with equal force.

6. If damper bar 140 contacts key 130B, but not key 130A, then the pivot point defined by fastener 800L is raised by adjusting mechanism 175L until damper bar contacts keys 130A and B with equal force.
7. Next nut 1020 on screw 1015 is adjusted so that the upper surface of damper bar 140 is urged against all keys 130A, B, C, etc., with the same force. This completes the damper bar adjustment.

CONCLUSION, RAMIFICATIONS AND SCOPE

I have devised an improved method and mechanism for adjusting the damping of musical sounds emitted by a keyboard percussion instrument after a key has been struck. This is accomplished by adjusting the height of pivot points of a damping bar in a keyboard percussion instrument. My mechanism requires no tools; instead the user makes all adjustments manually using thumbscrews. The thumbscrews are easily reached from outside the instrument so that the height of the damping bar pivot points can be rapidly adjusted, i.e., between musical performances or between music pieces. A pivot point at one end of a damping bar can be fixed in position, while the pivot point at the opposite end of the damping bar is adjustable.

Instead of manually urging thumbscrews to raise and lower the pivot point, an electric or pneumatic motor can be used. While the examples discussed relate to marimbas and vibraphones, the principles of my system apply to all keyboard percussion instruments that employ damping of vibrations that have been induced in vibrating parts including keys, bars, and even strings.

Thus the scope should be determined by the appended claims and their legal equivalents, rather than the examples and particulars given.

The invention claimed is:

1. A keyboard percussion instrument, comprising:

a plurality of frame members, a plurality of sound key supports secured to said frame members, a plurality of sound keys that rest on said key supports, each of said keys having a top side and an underside, a damping bar having first and second ends and arranged to be moveable into or out of contact with said undersides of said keys, a pair of pivot height adjusting mechanisms secured to said frame members, said pivot height adjusting mechanisms each comprising a housing, a movable post having a pivot point, and an adjusting thumbscrew arranged to adjust a height of said movable post up and down, a pair of pivot arms, each having first and second ends, said first ends of said pivot arms being secured respectively to said first and second ends of said damping bar and said second ends of said pivot arms being secured respectively to said pivot points of said movable posts of said pair of pivot height adjusting mechanisms, whereby each of said adjusting thumbscrews is arranged to adjust the height of its associated post and its pivot point, which in turn adjusts a height of said second end of the pivot arm connected to said pivot point and hence a height of the second end of said damper bar that is secured to said second end of said pivot arm, a spring secured to one of said frame members and arranged to urge said damping bar into contact with said undersides of said keys, a pedal hingeably secured to one of said frame members, a connecting member having a first end connected to said pedal and a second end connected to said damping bar, so that when said pedal is actuated, said damping bar is removed from said contact with said undersides of said keys, and when said pedal is released, said damping bar is urged by said spring into contact with said undersides of said keys, whereby when said damping bar is urged to move up by said spring when said pedal is released, said damping bar contacts said undersides of said keys in a manner determined by said adjusting thumbscrews.

2. The instrument of claim 1 wherein each of said pivot height adjusting mechanisms has means for locking said moveable post in position.

3. The instrument of claim 1 wherein said means for locking is a tightening thumbscrew for pressing and frictionally securing said post, and said cover plate of each tightening thumbscrew is adjusted.

4. The instrument of claim 3 wherein said pivot height adjusting mechanisms each include a cover plate with first and second holes and a hinge point screw, and a tightening thumbscrew passing through a first of said holes and said hinge point screw passing through said second of said holes, so that when loosely secured against said cover plate, said hinge point screw provides an anchor for said cover plate when said tightening thumbscrew is tightened.

5. The instrument of claim 4 wherein a respective post at a predetermined position in a respective height adjusting mechanism when a respective pivot height adjusting mechanisms are made of materials selected from the group consisting of plastic, metal, and wood.

6. The instrument of claim 1 wherein said second ends of said pivot arms each have a hole therethrough and said moveable posts each have a hole therethrough, and further including a pair of fasteners, each extending through said hole in a respective pivot arm and said hole in a respective moveable post so as to journal each of said pivot arms to a respective moveable post.

7. The instrument of claim 1 wherein said instrument has a plurality of bass keys and a plurality of treble keys and said pivot points of said movable posts are adjustable for urging said damping bar into contact with said underside of said keys in a predetermined manner in order to provide damping selected from the group consisting of damping all keys simultaneously, damping said treble keys, and damping said bass keys.

8. A method for adjustably positioning a damper bar in a keyboard percussion instrument, comprising:

providing a damper bar having first and second ends, providing a pivot arm having first and second ends, said first end of said pivot arm being secured to said first end of said damper bar, and said second end of said pivot arm including a pivot hole, such that adjusting a height of said second end of said pivot arm will cause a height of said first end of said damper bar to be adjusted, providing a pivot point height adjusting mechanism having a height-adjusting thumbscrew and a post extending from said mechanism, said post including a hole at one end distal from said mechanism, and said height-adjusting thumbscrew arranged to adjust a height of said hole from said mechanism, providing a fastener, joining said pivot hole of said pivot arm to said hole in said post using said fastener to provide a pivot point, and adjusting said height adjusting thumbscrew to adjust a height of said pivot point from said mechanism, which will in turn adjust a height of said first end of said pivot arm and hence the height of said first end of said damper bar.

9. The method of claim 8, further including providing a second pivot point height adjusting mechanism with a second height-adjusting thumbscrew and a second post extending from said second mechanism, said second post including a second hole at one end distal from said second mechanism, and said second height-adjusting thumbscrew arranged to adjust a height of said second hole from said second mechanism, a second pivot arm having first and second ends, said first end of said second pivot arm being secured to said second end of said damper bar, and said second end of said second pivot arm including a second pivot hole, such that adjusting a height of said second end of said second pivot arm will cause a height of said second end of said damper bar to be adjusted, providing a second fastener, joining said second pivot hole of said second pivot arm to said second hole in said second post using said second fastener to provide a second pivot point, and adjusting said second height adjusting thumbscrew to adjust a height of said second hole in said second pivot point from said second mechanism, which will in turn adjust a height of said first end of said second pivot arm and hence the height of said second end of said damper bar.

10. The method of claim 9, further including providing a keyboard percussion instrument having a plurality keys and a plurality of frame members, including at least a first frame member, and securing said pivot height adjusting mechanism to said first frame member.

11. The method of claim 10 wherein said instrument has second and third frame members, and further including:

providing a pedal secured to said second frame member, providing a connecting member connecting said pedal to said damper bar, providing a spring secured to said third of said frame members, said spring urging said damper bar against said plurality of keys, said pedal and said connecting member being arranged so that when said pedal is actuated, said connecting member will move said damper bar away from keys, and when said pedal is released, said spring will urge said damper bar against said plurality of keys.

12. The method of claim 11 wherein each of said plurality of keys has upper and lower surfaces, said damper bar having an upper surface so that when said pedal is released, said upper surface of said damper bar contacts said lower surfaces of said keys, thereby damping vibrations of said keys.

13. The method of claim 11, further including adjusting said first and second pivot height adjusting thumbscrews so that said upper surface of said damper bar contacts said lower surface of a plurality of said keys in an area selected from the group consisting of bass keys, treble keys, and all keys.

14. The method of claim 8, further including providing a housing for said pivot point height adjusting mechanism, said housing having a cover plate having first and second holes, said tightening thumbscrew passing through a first of said holes, and providing a hinge point screw, said hinge point screw passing through said second of said holes, so that when loosely secured against said cover plate, said hinge point screw provides an anchor for said cover plate when said tightening thumbscrew is tightened.

15. A damping mechanism for a keyboard percussion instrument having a plurality of keys with underside surfaces, comprising:

a damper bar having upper and lower surfaces and first and second ends and arranged to be moveable against said undersides of said keys to dampen their sound and away from said undersides of said keys so as to allow said keys to ring freely, means for moving said damper bar to contact or be spaced from said undersides of said keys, a pair of pivot arms which each have first and second ends, said first ends of the pivot arms fixedly secured to said first and said second ends of said damper bar, respectively, each pivot arm having a pivot point at its second end, a pair of height adjusting members and a pair of respective posts, each post having an end with a pivot point, said ends of said posts being rotatably joined to a respective one of said pivot points of said pivot arms, each height adjusting member arranged to adjust a height of its associated post for enabling the heights of said posts to be adjusted individually by individual adjusting members, whereby said height adjusting members can be used to adjust the heights of said posts and hence heights of said pivot points of said posts and said pivot arms, thereby to adjust positions of said first and seconds ends of said damper bar, so that said damper bar is arranged to contact said undersides of said keys in a selectable manner.

16. The damping mechanism of claim 15 wherein said means for moving said damper bar includes pedal means for raising and lowering said damper bar so that actuating said pedal removes said damper bar from contact with said keys, and when said pedal is released said damper bar is urged into contact with said underside surfaces of said keys.

17. The damping mechanism of claim 16 wherein said means for moving said damper bar includes a spring for urging said damper bar to contact said undersides of said keys.

18. The damping mechanism of claim 15 wherein said height adjusting members comprise a pair of thumbscrews and further including a pair of tightening members for fixedly securing a position of either of said posts.

19. The damping mechanism of claim 15 wherein said pivot arms are made from materials selected from the group consisting of metal, plastic, reinforced plastic, and wood.

20. The damping mechanism of claim 15, further including a percussion instrument having a set of keys and a frame for supporting said set of keys and said damping mechanism, said set of keys being positioned in at least one horizontal row on said frame, said damper bar being positioned under said row of keys, and said pair of pivot arms, said pair of height adjusting members and said pair of posts being positioned to a side of said row of keys.

* * * * *